United States Patent [19]

Milewicz

[11] 3,981,617

[45] Sept. 21, 1976

[54] MARINE PROPELLER LOCK

[76] Inventor: Norbert W. Milewicz, 1194 Rolling Hills, Bloomfield Hills, Mich. 48013

[22] Filed: Aug. 1, 1974

[21] Appl. No.: 493,529

[52] U.S. Cl. ..... 416/244 B; 416/146 R; 70/371

[51] Int. Cl.[2] ..... B63H 1/20

[58] Field of Search ..... 416/244, 146, 169, 134; 70/371, 182, 231, 232

[56] References Cited

UNITED STATES PATENTS

| | | | |
|---|---|---|---|
| 1,625,901 | 4/1927 | Lay | 70/232 |
| 1,748,422 | 2/1930 | Lee | 70/371 X |
| 1,757,761 | 5/1930 | Wendt | 416/93 |
| 1,900,146 | 3/1933 | Winkler | 70/231 X |
| 2,534,446 | 12/1950 | Howard | 70/231 |
| 2,543,396 | 2/1951 | Wolff | 416/169 UX |
| 3,246,698 | 4/1966 | Kiekhaefer | 416/93 |
| 3,444,932 | 5/1969 | Wlezien | 416/93 |
| 3,540,245 | 11/1970 | Pope | 70/231 |
| 3,563,670 | 2/1971 | Knuth | 416/93 |
| 3,732,033 | 5/1973 | Macchi | 416/244 |
| 3,764,228 | 10/1973 | Shook | 416/93 |
| 3,782,146 | 1/1974 | Franke | 70/232 |

FOREIGN PATENTS OR APPLICATIONS

| | | | |
|---|---|---|---|
| 905,466 | 3/1954 | Germany | 70/371 |

*Primary Examiner*—Everette A. Powell, Jr.
*Attorney, Agent, or Firm*—Barnes, Kisselle, Raisch & Choate

[57] ABSTRACT

For use with a marine propeller which is mounted on an output shaft of a power source, a marine propeller lock comprising a fastener on the shaft for preventing axial movement of the propeller on said shaft and a cover member having a portion thereof engaging the end of the shaft and another portion thereof surrounding the fastener on the output shaft. The fastener has an opening in the end thereof projecting beyond the end of the shaft and the cover engages the shaft and has an opening therein aligned with the opening in the fastener. A lock is insertable through the opening in the cover into the opening in the fastener and has interengaging means thereon engaging the fastener to hold said cover in position and thereby prevent access to said fastener.

8 Claims, 9 Drawing Figures

MARINE PROPELLER LOCK

This invention relates to a marine propeller lock to prevent unauthorized removal of marine type propellers from an inboard motor, outboard motor, inboard-outboard motor or similar water propulsion device.

BACKGROUND OF THE INVENTION

With the extended use of marine devices that use marine type propellers such as are mounted on inboard motors, outboard motors, inboard-outboard motors, or similar water propulsion devices, a problem that is becoming more prevalent is the unauthorized removal and theft of expensive marine type propellers.

Accordingly, the provision of a satisfactory lock is very desirable. However, there are several major problems. One is that such a lock could become incompatible when applied to a high speed marine propeller if it causes any unbalance to the precision balanced assembly and may thereby reduce the efficiency of the propulsion device and possibly shorten its life expectancy. Secondly, the lock is subject to contamination by water, solids and the like, and also tends to corrode.

Accordingly, among the objects of the invention are to provide a satisfactory marine type propeller lock which will effectively prevent unauthorized removal or substitution of any propeller while the boat is operational in the water, stored on land, or being transported by land; which is effective without loss of engine efficiency; which is adaptable to inboard motors, outboard motors, inboard-outboard motors and similar water propulsion devices; which is adaptable to various propeller fastening means such as nut and cotter pin and lock tab washers, nut and locking pin, nut and keyed tapered shaft, self-locking nuts and the like; which will prevent willful, malicious or accidental tampering with the propeller that might result in propeller loss under power; which can be utilized on the output shaft of the power source even when the propeller is removed to prevent damage to the propeller and still protecting the output shaft end while the boat is being handled on shore or on land; which is self-cleaning so that the tendency for corrosion, contamination with solids and the like is minimized; and which is self-lubricating.

SUMMARY OF THE INVENTION

In accordance with the invention, the marine propeller lock comprises fastener means on the shaft that supports the propeller for preventing axial movement of the propeller on the shaft. A cover member has a portion thereof engaging the end of the shaft and another portion thereof surrounding the fastener means on said output shaft. The fastener means has an opening in the end thereof projecting beyond the end of the shaft. The cover engages the shaft and has an opening therein aligned with the opening in the fastener means. A lock is insertable through the opening in the cover into the opening in the fastener means and has interengaging means thereon engaging the fastener means to hold the cover in position and thereby prevent access to said fastener means. Means are provided to define a passage between the cover and the fastener and the cover has openings such that the water passing therebetween flows about the fastener means. In a preferred form, the cover is constructed such that it mechanically engages the fastener forwardly of the lock to prevent the cover from rotating independently of the lock and to provide radial support for the cover. The interior of the cover is constructed to cause the water to pulsate and thereby improve the cleaning action.

DESCRIPTION

Figure 1:
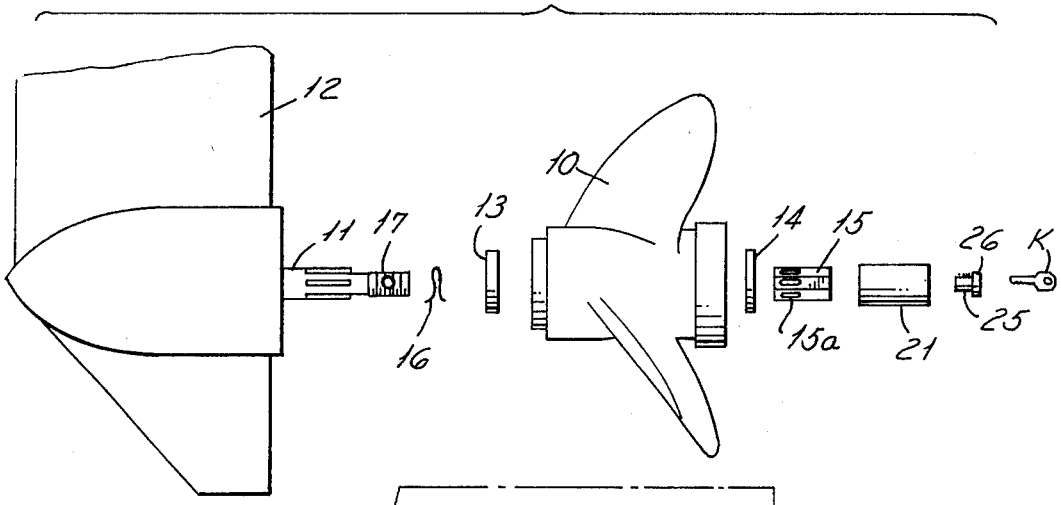
FIG. 1 is an exploded view of a marine propeller system embodying the invention.

Referring to FIG. 1, the invention is directed to locking a propeller 10 on an output shaft 11 of a marine propulsion device 12, such as an outboard motor, inboard-outboard motor, or inboard motor.

Conventionallly, the propeller 10 is held on the shaft 11 by a fastener such as a nut and cotter pin, nut and lock tab washers, nut and locking pin, nut and keyed tapered shaft, self-locking nuts, or the like.

When the invention is applied to one such type of fastening, the propeller 10 is mounted on the shaft 11 rotatably mounted on a motor housing 12 and a conventional thrust washer 13 is interposed between the propeller 10 and shaft 11 (FIG. 1). A spacer 14 is placed on the shaft in engagement with the propeller 10. Further, in accordance with the invention, a fastener 15 is threaded on the shaft 11 and a cotter pin 16 is inserted through openings in the fastener 15 and an opening 17 in the shaft.

As shown in FIGS. 2, 3–5, the fastener 15 engages the spacer 14 and is threaded for a portion of its length for engagement with the threaded portion of the shaft 11. A portion of the fastener 15 extends beyond the end of the shaft 11 and is provided with annular grooves 18. Radial openings 19 provide communication between grooves 18 and the exterior of fastener 15. The exterior of the fastener is non-circular, herein shown as hexagonal, to facilitate engagement of a wrench for applying and removing the fastener.

Figure 2:
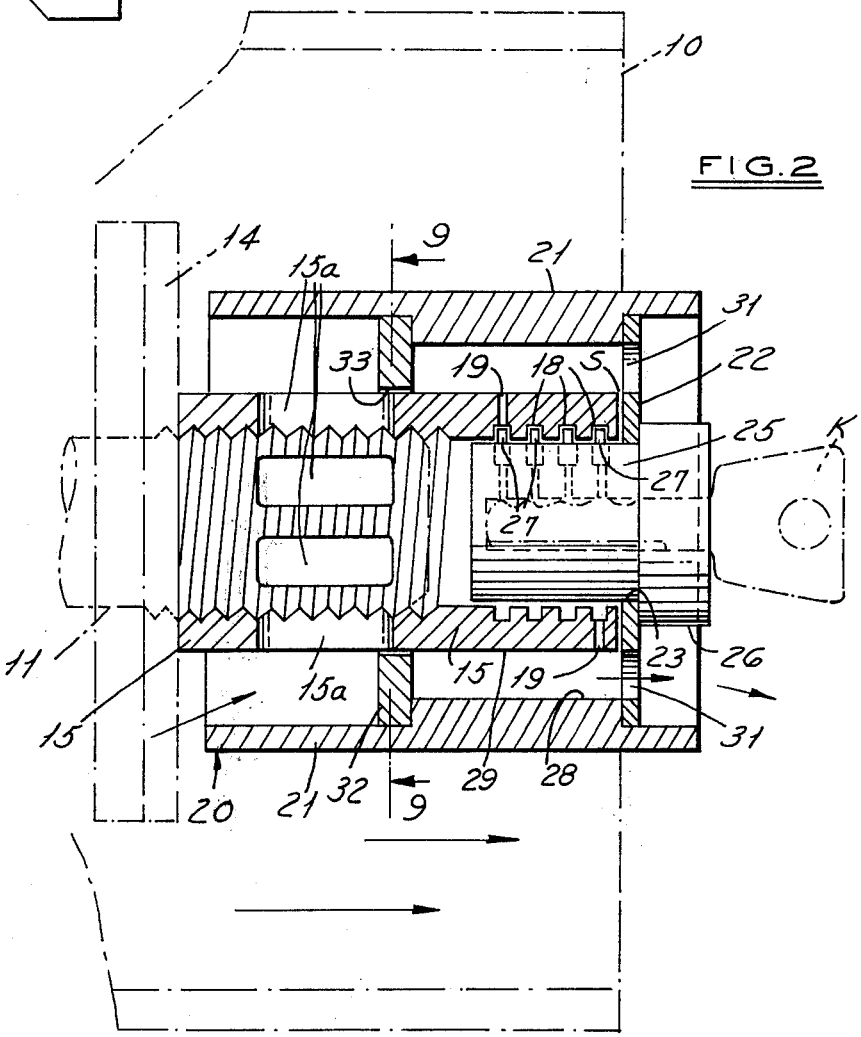
FIG. 2 is a longitudinal sectional view on an enlarged scale through a portion of the system.
Figure 3:
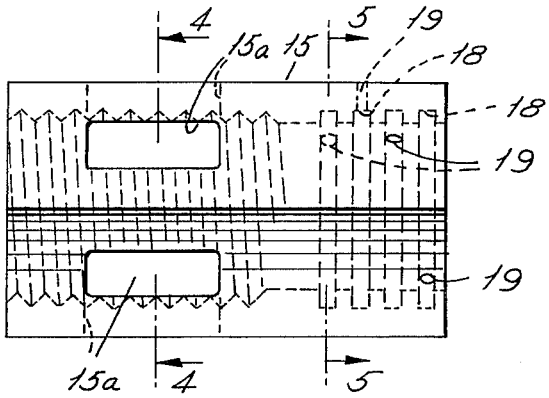
FIG. 3 is a side elevational view of a portion of the system.
Figure 4:
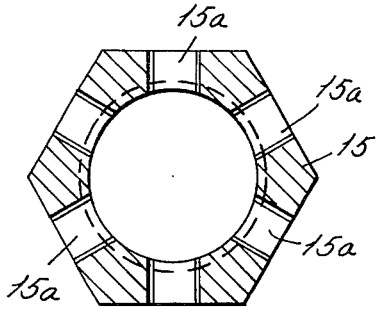
FIG. 4 is a sectional view taken along the line 4—4 in FIG. 3.
Figure 6:
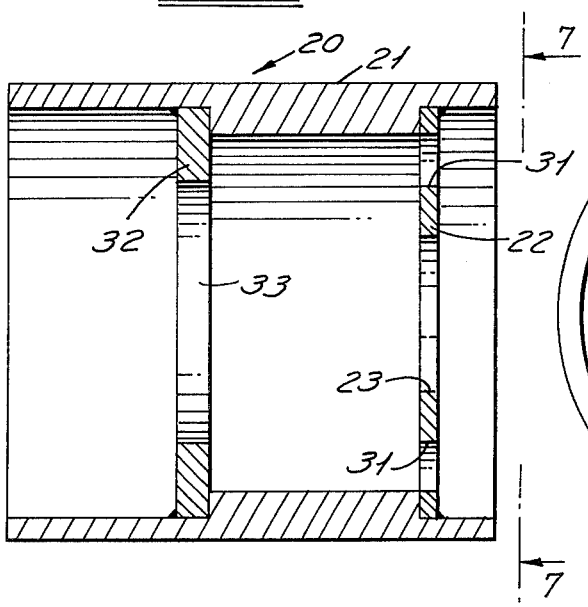
FIG. 6 is a longitudinal sectional view of another part of the system.
Figure 7:
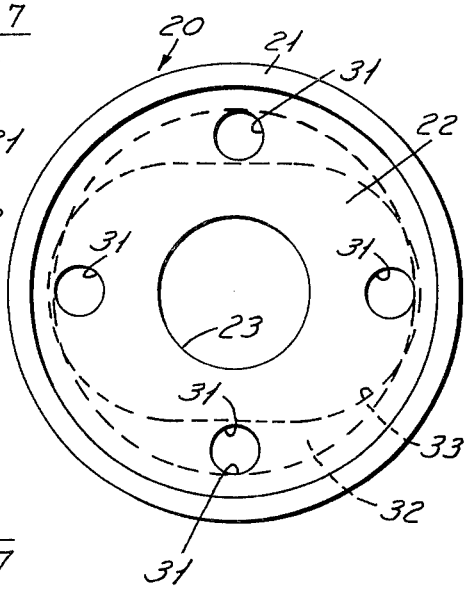
FIG. 7 is a view taken along the line 7—7 in FIG. 6.
Figure 5:
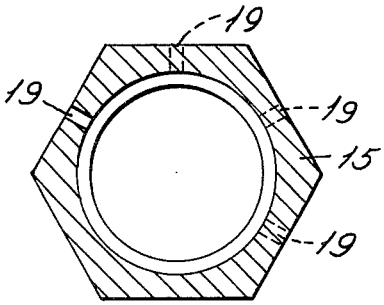
FIG. 5 is a sectional view taken along the line 5—5 in FIG. 3.
Figure 8:
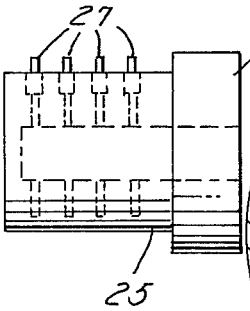
FIG. 8 is a side elevational view of another part of the system.
Figure 9:
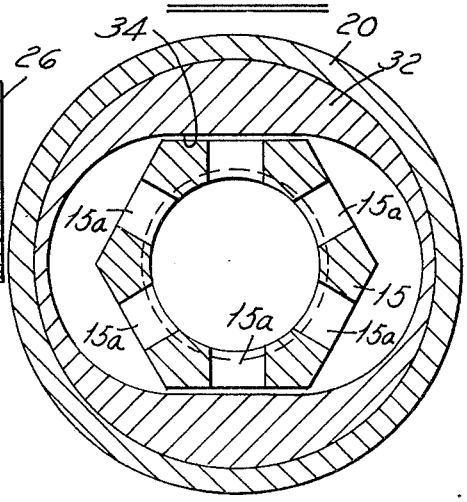
FIG. 9 is a sectional view taken along the line 9—9 in FIG. 2.

As shown in FIGS. 2, 6 and 7, a fastener cover 20 comprising a cylindrical portion 21 and an end wall 22 fixed thereto is slipped over the fastener 15 so that the wall 21 surrounds the fastener and particularly the cotter pin 16 preventing access and removal thereof. The end wall 22 of cover 20 is formed with a central opening 23 that is aligned with the opening of the fastener and a lock member 25 is inserted into the opening and has an enlarged end 26 that engages the outer surface of the end wall 22 of cover 20. The lock 25 is of the type that has radially extending plungers 27 that are normally urged outwardly and retracted when the key K is inserted. When in position, the plungers 27 engage the annular grooves 18 holding the cover 20 in position.

In operation, the lock 25 and cover are symmetrical with respect to the axis of the shaft so that they do not contribute any unbalance which might affect the operation or the life of the propeller or propulsion device.

As further shown in the drawings, the cover 20 has its interior surface 28 spaced from the outer surface 29 of the fastener so that water can pass freely between the fastener 15 and cover 20. The end wall 22 is formed with axial openings 31 which are equally spaced circumferentially so that the water passes freely through the space between the fastener and the cover. Cover 20 also includes a transverse wall 32 fixed to the cylindrical portion 21 intermediate the ends thereof. Wall 32 includes an oblong centrally located opening 33 having its major axis aligned with at least two of the openings 31 in the end wall 22. The long sides 34 of the opening are closely spaced with the two exterior surfaces of fastener 15 so that the cover 20 engages the fastener 15 to provide radial support for the cover and, upon rotation of the propeller, the cover rotates with the fastener 15.

In use, as the boat moves through the water, the cover 20 rotates under power at the speed of the propeller. This rotation causes a scavaging action through the openings 19 that extend radially to the grooves 18. This necessary pumping and scavaging action accomplishes the self-cleaning and self-lubricating features of the invention. The provision of an unsymmetrical opening 34 in the transverse wall 32 provides a pulsating flow further facilitating the cleaning and lubricating action.

The flow of water in the space between the fastener and the cover causes a high volume, low pressure flow removing contaminants. The pressure through the holes 31 induces high flow rates because of the pressure drop over the orifice holes and the rotation of the nut and, in turn, the cover 20 creates a turbulent flow between the fastener and the cover to provide an agitating action for the proper self-cleaning of the lock.

In operation, by a combination of pressure differentials created by rotation of the propeller shaft, additional water is introduced through the key insertion slot of the lock assembly 25 flowing through the lock and through the annular grooves to the space between the fastener and the cover and out through the openings 31.

The flow of water is shown more clearly in FIG. 2 by the arrows.

Where the propulsion device is such that exhaust gases are discharged adjacent the propeller, the exhaust gases tend to collect at points of low pressure so that they will pass to the space S between the ends of the fastener 15 and wall 22 of cover 20 and then flow into the four lock retaining grooves flowing out of the groove holes and coating the lock tumblers with a light deposit of lubricating film that is a byproduct of internal combustion engines.

Although the invention has been described in connection with a propeller construction utilizing a cotter pin, it is also applicable to prevent access to other types of fastening such as nut and lock tab washers, nut and locking pin, nut and keyed tapered shaft, self-locking nuts and the like.

It can thus be seen that there has been provided a locking device which will effectively prevent unauthorized removal or substitution of any propeller while the boat is operational in the water, stored on land, or being transported by land; which is effective without loss of engine efficiency; which is adaptable to inboard motors, outboard motors, inboard-outboard motors or similar water propulsion devices; which is adaptable to various propeller fastening means such as nut and cotter pin, nut and lock tab washers, nut and locking pin, nut and keyed tapered shaft, self-locking nuts and the like; which will prevent malicious, willful or accidental tampering with the propeller that might result in propeller loss under power; which can be utilized on the output shaft of the power source even when the propeller is removed to prevent damage to the propeller while the boat is being handled; which is self-cleaning so that the tendency for corrosion, contamination with solids and the like is minimized; and which is self-lubricating.

I claim:

1. For use with a marine propeller which is mounted on an output shaft of a power source and which has generally axial openings therein for the passage of engine exhaust gases and engine cooling exhaust waters under high pressure through the propeller hub, the combination comprising removable fastener means on said shaft for limiting axial movement of the propeller on said shaft, a cover member having a first end portion thereof adjacent the outer end of the fastener means and a second portion thereof surrounding said fastener means on said output shaft, a lock insertable through said cover member into said fastener means and having interengaging means thereon engaging said fastener means to hold said cover in position on said shaft and thereby prevent access to said fastener means, said fastener means, said cover member and said lock being such that, upon rotation, no adverse unbalance is produced, said second portion of said cover having a free end spaced from the inner end of said fastener means to provide a space through which engine cooling exhaust water and engine gases may flow, said second portion of said cover being spaced from said fastener means to permit flow of water and exhaust gases substantially axially therethrough, said first end portion of said cover having openings therein permitting the flow of water and exhaust gases therethrough, said lock having an axial opening and a radial opening therein extending to said interengaging means whereby water can flow into said lock through said axial opening and out of said lock through said radial opening past said interengaging means, first passage means from said space between said cover and said fastener means to the interior of said fastener means, second passage means from the interior of said fastener means to the space between said cover and said fastener means, such that exhaust water and exhaust gases flow through said openings in said end portion of said cover to produce a pressure drop to cause flow radially inwardly through said first passage means and induce a flow out of said lock through said second passage means so that exhaust gases entrapped with said water tend to deposit a lubricating film on the interengaging means of said lock and the water removes contaminants and foreign particles from said lock.

2. The combination set forth in claim 1 wherein said first passage means comprises a space formed between said fastener means and said end portion of said cover.

3. The combination set forth in claim 2 wherein said interengaging means of said lock comprises radially extendable projections, said fastener means having grooves which are engaged by said projections, said second passage means comprising radial openings from said grooves to the exterior of said fastener means.

4. The combination set forth in claim 1 including circumferentially spaced means on said cover extending inwardly of said portion of said cover for producing a pulsating effect on water flowing between said cover and said fastener means.

5. The combination set forth in claim 4 wherein said last-mentioned means engage portions of said fastener means.

6. The combination set forth in claim 1 including removable auxiliary fastener means for locking said removable fastener means relative to said shaft.

7. For use with a marine propeller which is mounted on an output shaft of a power source, the combination comprising removable fastener means on said shaft for limiting axial movement of the propeller on said shaft, a cover member having a first end portion thereof adjacent the outer end of the fastener means and a second portion thereof surrounding said fastener means on said output shaft, a lock insertable through said cover member into said fastener means and having interengaging means thereon engaging said fastener means to hold said cover in position on said shaft and thereby prevent access to said fastener means, said fastener means, said cover member and said lock being such that, upon rotation, no adverse unbalance is produced, said second portion of said cover having a free end spaced from the inner end of said fastener means to provide a space through which engine cooling exhaust water and engine exhaust gases may flow, said second portion of said cover being spaced from said fastener means to permit flow of water and exhaust gases substantially axially therethrough, said first end portion of said cover having openings therein permitting the flow of water and exhaust gases therethrough, said lock having an axial opening and a radial opening therein extending to said interengaging means whereby water can flow into said lock through said axial opening and out of said lock through said radial opening past said interengaging means, passage means from the interior of said fastener means to the space between said cover and said fastener means, such that water will flow through said axial opening and said radial openings in said lock and said passage means to remove contaminants and foreign particles from said lock.

8. The combination set forth in claim 7 wherein said interengaging means of said lock comprises radially extendable projections, said fastener means haivng grooves which are engaged by said projections, said passage means comprising radial openings extending from said grooves to the exterior of said fastener means.

* * * * *